United States Patent [19]

Brewer, Sr. et al.

[11] Patent Number: 4,817,882

[45] Date of Patent: Apr. 4, 1989

[54] MEASURING, CUTTING AND ROLLING APPARATUS

[76] Inventors: Clarence R. Brewer, Sr., P.O. Box 247; Mark D. Young, 421 Reservoir Ave., both of Central City, Ky. 42330

[21] Appl. No.: 105,124

[22] Filed: Oct. 6, 1987

[51] Int. Cl.[4] ..... B65H 19/26

[52] U.S. Cl. ..... 242/56 R; 242/72 R; 242/58.6; 242/67.3 R

[58] Field of Search ..... 242/56 R, 72 R, 58, 242/58.6, 79, 74.1, 110.2, 67.3 R

[56] References Cited

U.S. PATENT DOCUMENTS

| | | | |
|---|---|---|---|
| 1,961,984 | 6/1934 | Pyle | 242/72 R |
| 2,270,064 | 1/1942 | Littell | 242/110.2 |
| 2,525,346 | 10/1950 | Gilbert | 242/58.6 X |
| 2,595,593 | 5/1952 | Manning | 242/56 R |
| 2,834,558 | 5/1958 | Halpin | 242/56 R |
| 3,386,678 | 6/1968 | Malone | 242/56 R |
| 4,105,169 | 8/1978 | Alinder | 242/56 R |
| 4,117,986 | 10/1978 | Hutzenlaub | 242/56 R X |
| 4,160,528 | 7/1979 | Malone et al. | 242/56 R |
| 4,650,456 | 3/1987 | Armington | 242/58.6 X |
| 4,695,005 | 9/1987 | Gietman | 242/56 R |

*Primary Examiner*—John M. Jillions

*Attorney, Agent, or Firm*—Larson and Taylor

[57] ABSTRACT

An apparatus is provided for measuring, cutting, and rolling material such as floor covering. The apparatus includes a wheeled support frame which receives a base roll of material from which material is unwound a material take-up shaft device onto which material from the base roll is wound. The take-up shaft device includes a pair of outwardly expandable bars which clamp the edge of the material in place on the take-up device and which can be contracted to release the old material from the take-up device. The take-up device is releasably mounted on the support frame by a mechanism which permits the entire take-up device with a roll of material wound thereon to be removed from the remainder of the apparatus. A measuring device measures the length of the material wound onto the take-up device and a floating cutting table assembly including a cutting bar assists in cutting off the material from the base roll when the material wound onto the take-up device is of the desired length.

17 Claims, 5 Drawing Sheets

105
120
118
122
116
114
112
118
114
112
114
90
88
95
94
92
124
124
105
105a

MEASURING, CUTTING AND ROLLING APPARATUS

FIELD OF THE INVENTION

The invention relates to a measuring, cutting and rolling apparatus for rolled web materials, and in particular, for floorcoverings such as broadloom carpet and vinyl. Background of the Invention A number of devices and systems have been developed for measuring, cutting and rolling materials of various types including carpet and other floor coverings. Examples of such devices are disclosed in the following patents: U.S. Pat. Nos. 2,595,593 (Manning); 3,386,678 (Malone); 3,537,662 (Keesling et al); 3,931,940 (Raighn); 4,002,308 (Feighery); 4,105,169 (Alinder); 4,120,463 (Alinder); 4,160,528 (Malone, Sr. et al) and 4,273,300 (Wojtowicz et al).

Briefly considering some of the patents referred to above, the Manning patent discloses a portable machine for cutting, measuring and rolling linoleum or carpet which is intended to be used in a retail environment with the support rolls mounted on other than the machine itself. The machine includes a counter and a roll-up drum which can be disengaged after a desired length of linoleum has been rolled up on the drum. An electric motor turns a threaded shaft to provide movement of a cutting blade along the shaft, to thereby cut the linoleum to the desired length. The Raighn patent discloses a feeding, measuring and rolling apparatus including an arm structure which can be swung to permit dumping of a take-up roll. The earlier issued Alinder patent discloses a portable measuring and cutting apparatus for floor covering which is adjustable to accommodate varying carpet widths and which is mounted on rollers. The supply or base roll can be mounted on other than the machine but can also be mounted on braces attached to the machine itself. A clamping plate clamps the leading edge of the carpet to a motor driven take-up shaft. A measuring device is disposed between the supply and take-up rolls and a knive moving through a guide tube provides cutting of the carpet. The later issued Alinder patent discloses a device which is a stationary version of the device disclosed in the earlier patent. The device is operated by a single operator and includes an arrangement for loading and unloading bulk rolls and for unloading the measured and cut roll.

SUMMARY OF THE INVENTION

In accordance with the present invention, a portable apparatus is provided for accurately measuring, rolling and cutting material such as floor coverings, e.g., broadloom carpet and vinyl. Although the apparatus is of general application, it is particularly adapted for use with floor coverings of widths under about 13 feet and, among many other advantages, the apparatus can be used in a small space, e.g., in an area as small as 5'×15' for the particular application referred to.

The apparatus of the invention is useful in a number of different applications and is light enough to permit transportation thereof to any job site using a standard installation van. The apparatus can be readily adapted to any free-standing vinyl or carpet wall rack, thus eliminating the long-existing problem of having to provide a large amount of floor space in front of these racks for cutting purposes. Further, in accordance with one embodiment of the invention, floor covering can be measured and rolled directly from a fork lift without having to remove the material from the carrier pole of the fork lift. In another embodiment, a fork lift is not required and the apparatus itself hydraulically loads the floor covering.

In accordance with the invention, a measuring, cutting and rolling apparatus is provided which comprises: a movable support frame; support means mounted on the support frame for receiving and supporting a base or supply roll of material so that the material can be unwound from that roll; an expandable material take-up shaft device mounted on the support frame onto which material from the base roll is wound; means for rotating the take-up shaft device so as to provide winding of material from the base roll onto the take-up shaft device; releasable mounting means for releasably mounting said take-up shaft device on the support frame so as to permit the take-up shaft device with a rolled material wound thereon to be released from the apparatus; measuring means, mounted on the support frame, for measuring the length of material wound onto the take-up shaft device; and means, mounted on the support frame, for assisting in cutting off the material from the base roll when the material wound onto the take-up shaft device is of the desired length. The expandable take-up shaft device comprises expandable and contractable means for releasably clamping material from the base roll to the take-up device and for, when contracted, enabling the take-up shaft device to be removed from the wound roll after the take-up shaft device has been released from the rest of the apparatus.

Preferably, the expandable take-up device comprises a fixed edge holding bar, at least one movable bar, and movement control means for causing movement of the movable bar between a first, open position spaced from the edge holding bar so as to define a gap therebetween through which the free edge of the material from the base roll can be inserted and a second, clamping position wherein the free end of the material is clamped between the edge holding bar and the movable bar. Advantageously, the movement control means includes a rotatable screw member, a travelling nut movable longitudinally along the screw member, at least one pivotable connector member, connected to the travelling nut and to the movable clamping bar, which pivots responsive to movement of the travelling nut to provide lateral expansion and contraction of the clamping bar, and means for controlling movement of the travelling nut along the screw member. In a preferred embodiment, the take-up shaft device includes a central shaft and a further movable bar located on the opposite side of the central shaft from the first bar and connected by a further connector member to the travelling nut, and a plurality of spreader links which interconnect the central shaft to the movable bars to enable expansion and contraction thereof.

Preferably, the support frame comprises first and second separable units and includes latching means for releasably connecting these units together. Advantageously, the support means for the base or supply roll is mounted on the first unit while the remaining components of the apparatus, i.e., the take-up shaft device, the releasable mounting means, the measuring means and the cutting means, are mounted on the second unit.

In accordance with one preferred embodiment of the invention, the support means comprises means defining a V-shaped cradle or rack at each end of the support frame into which the base roll of material is lowered and which supports that base roll. Preferably, frame members of the sides of the support frame form these cradles.

In a further preferred embodiment, the support means for the base or main roll comprises a pair of support arms for receiving that roll and hydraulic means for lifting and lowering the support arm so as to enable receipt of the base roll by the arms as well as raising of the base roll to an operative position, thereby eliminating the need for a fork lift.

The support frame preferably includes side portions and an elongate upper frame member which extends between the side portions, and the cutting means preferably comprises a floating cutting table assembly, hinged along one edge thereof to the upper frame member, which bears against the material roll as the material is being wound onto the take-up shaft device. A cutter bar is located at the free edge of the floating table assembly (opposite the hinged edge) which assists in cutting the material to length.

In a preferred embodiment, the take-up shaft device is released from the remainder of the apparatus by means of an arrangement including a tongue and groove connection between a central shaft of the take-up shaft device and a stub shaft which drives the device, and control means for providing disengagement of the main shaft from the stub shaft at the tongue and groove connection. This control means advantageously comprises a pair of pivotable control members disposed adjacent to respective ends of the main shaft which are movable to exert force on these main shaft ends and thereby cause disengagement of the take-up shaft from the stub shaft, and from the mounting in which the shaft is supported, when the tongue and groove connection is in a predetermined angular orientation. Each of the control members preferably includes an offset portion at the pivoted end thereof which is disposed under the main shaft and which exerts a lifting force on the main shaft when the corresponding control member is pivoted into engagement with that end of the shaft. In a preferred embodiment, a single manually operable control handle is used to control movement of both of the control members, the control members being interconnected so that operation of the control handle, which preferably comprises an extension of one of the control members, provides operation of both control members.

Other features and advantages of the present invention will be set forth in, or apparent from, the detailed description of the preferred embodiments of the invention which follow.

DESCRIPTION OF THE PREFERRED EMBODIMENTS

Figure 1:
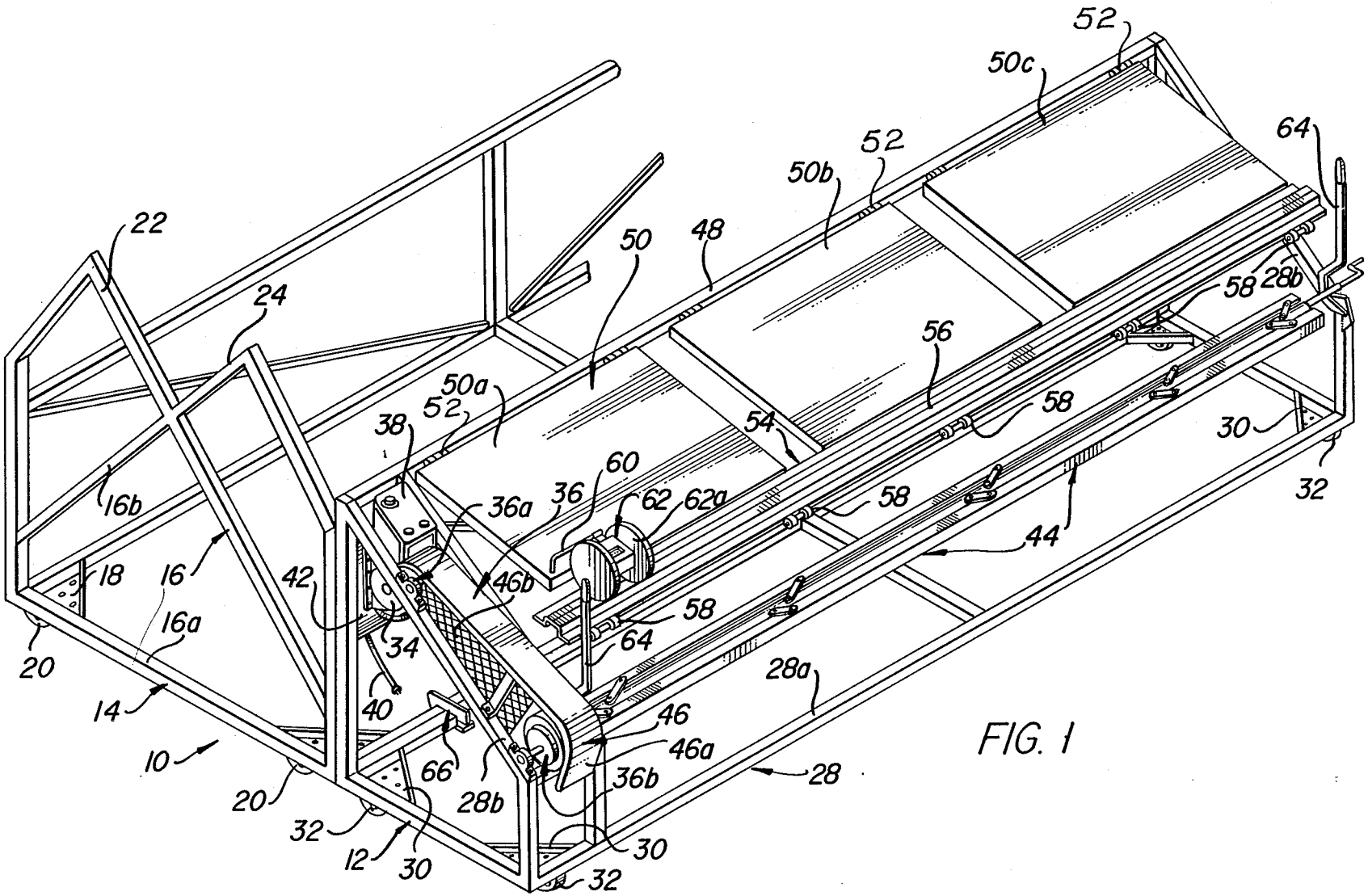
FIG. 1 is a perspective view of a preferred embodiment of the measuring, rolling and cutting machine of the invention, a portion of which is partially broken away.

Referring to FIG. 1, which is a perspective view of one preferred embodiment of the invention, the measuring, cutting and rolling machine of the invention is generally denoted 10 and includes two basic secions, viz., a main unit 12 and a "back rack" unit 14 on which the floor covering material to be measured, cut and rolled is received.

The back rack unit 14 comprises a back rack frame 16 comprising a base frame portion **16*a* including triangular support plates 18 at the corners thereof which support four caster wheels 20 (two of which can be seen in FIG. 1) and an upright frame portion 16*b* supported on base frame portion 16*a*. Upright frame portion 16*a* includes a pair of upper frame members 22 and 24 at each end (only one pair being visible in FIG. 1) which define a "V" therebetween that acts as a cradle in which the ends of a back sleeve pole or back pole 88 (see FIG. 11) is received. As explained below in connection with FIG. 5, back pole 88** carries the roll of the material to be measured, cut and rolled.

Main unit 12 comprises a main unit frame 28 which comprises a base frame portion **28*a* and an upright frame portion 28*b*, as illustrated. Similarly to the back rack base frame portion 16*a*, base frame 28*a* carries four triangular support plates 30 at the corners thereof which support four caster wheels 32**.

The vertical frame portion **28*b* is inclined from back to front, as illustrated, and supports a number of separate units of the machine thereon including, at one end thereof, a drive motor 34, a chain drive unit 36, and a motor control unit 38. Motor 34, which is powered through a connecting electrical cable indicated at 40, is mounted on a support panel 42 located on the side of vertical frame 28*b* in the illustrated embodiment; however, in a further advantageous embodiment, motor 34 can also be mounted on base frame portion 28*a*. Chain drive unit 36 includes a first drive sprocket 36*a* (only a portion of which is visible in FIG. 1) which is driven by motor 34, a second, spaced drive sprocket 36*b* which drives an expandable take-up shaft 44 as described below, and an interconnecting drive chain (not shown in FIG. 1). A sprocket and chain guard 46 including a contoured top wall 46*a* and a screen-like side wall 46*b*** protect users of the machine from the chain drive.

The uppermost frame member 48 of vertical frame portion **28*b* extends along the back of the main unit 12 and hingedly supports a free floating cutting table assembly (floatation table assembly) denoted 50. This assembly 50 includes three tables or panels 50***a*, 50*b* and 50*c* which are pivotably connected to frame member 48 by support hinges 52 so that the free ends thereof can "float". These free ends of tables 50*a*, 50*b* and 50*c* are connected to and support a cutting bar 54 in the form of an inverted channel member which extends over a majority of the length of the machine, as shown, and which provides a cutting site in the form of a longitudinal slit 56 into which the blade of a cutting knife (not shown) is inserted in order to provide cutting of the floorcovering material. A series of small roller bearings 58 are disposed along the outer edges of the floating cutting table assembly 50 which rest on, and ride on, the floorcovering material during the measuring process as described below.

In the illustrated embodiment, the leftmost table 50*a* includes a L-shaped support member 60 which supports a measuring counter device 62. Counter device 62 is conventional and includes measuring wheels 62*a* which contact the material to be measured and which rotate as the material is being unwound so that by counting the number of rotations of wheels 62*a*, a measurement is provided of the length of the material that is wound onto the expandable take-up shaft 44. A pair of control handles 64 are mounted on vertical frame portion 28*b* near the lower end of the inclined upper frame as illustrated. The handles 64 are part of one embodiment of a release mechanism for the take-up shaft 44 which is described below in connection wit FIGS. 8 and 9.

Figure 2:
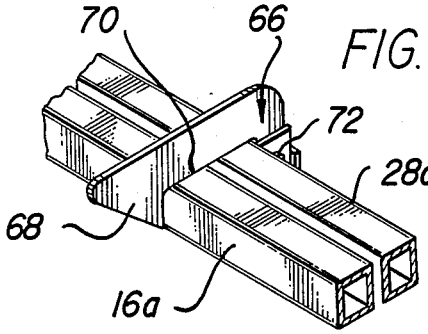
FIG. 2 is a perspective view of a detail of FIG. 1 showing the latching device which interconnects the two sections forming the machine.
Figure 3:
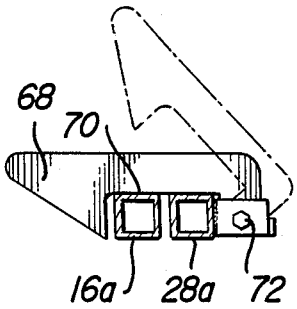
FIG. 3 is a side elevational view, partially in section, of the latching device of FIG. 2.

As illustrated in FIG. 1, the main unit 12 and the back rack unit 14 are releasably connected together by interlocking or latching devices 66 (one of which is shown in FIG. 1). As can be seen more clearly in FIGS. 2 and 3, latching device 66 comprises a pivotable latching member 68 having a slot 70 therein in which the adjacent base frame members 16*a* and 28*a* of the two units are received and which is pivotable about a pivot 72 to the latching position thereof, as illustrated in FIG. 3.

Figure 4:
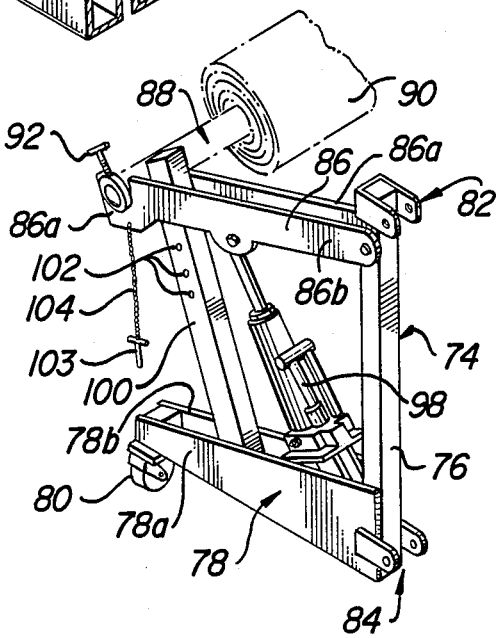
FIG. 4 is a perspective view of an alternate embodiment of the rear section of the machine of FIG. 1.

Referring to FIG. 4, an alternate embodiment to the "back rack" 14 of FIG. 1 is illustrated which employs hydraulic lifting and which thus avoids the need for a fork lift in placing the material roll on the machine. As shown, the hydraulic lifting assembly or unit of FIG. 4, which is generally denoted 74, includes a vertical support post 76 secured to a lower base frame 78 comprising spaced panel members 78*a* and 78*b*. A caster wheel 80 is provided at the distal end of frame 78 while upper and lower couplings 82 and 84 cooperate with bolts (not shown) to secure lifting unit 74 to the frame of main unit 12. It will be understood that two of such hydraulic lifting units 74 are employed, one at each end of the main unit frame.

A lifting arm 86, comprising spaced arm members 86*a* and 86*b* is pivotably mounted at the upper end of vertical support post 76 and includes an end portion 86*a* which is shaped to receive therein a back pole 88 for a material roll 90. As is shown in more detail in FIG. 11, back pole 88 includes a tightening bolt 92 and a pair of collars or stops 94 and 95 at one end thereof which serve in fixing the roll 90 in place on lifting arm 86 (or in the "V" or cradle of the back rack unit 14 of FIG. 1). Lifting of arm 86 is controlled by a hydraulic jack 98 which extends between base frame 78 and arm 86. A further, inclined support post or brace 100 extends from base frame 78 to a position between arm members 86*a*, 86*b* of lifting arm 86 so that lifting arm 86 moves up and down along post 100 under the control of hydraulic jack 98. Post or brace 100 includes a plurality of holes 102 formed therein which are arranged in a row as shown and which are adapted to receive a locking pin 103 therein. Locking pin 103 is suspended from lifting arm 86 by a support chain 104 and when lifting arm 86 is lifted to the desired position (height) by hydraulic jack 98, pin 103 is inserted into one of the holes 102 in support post 100 so as to maintain lifting arm 86 at that height.

Figure 5:
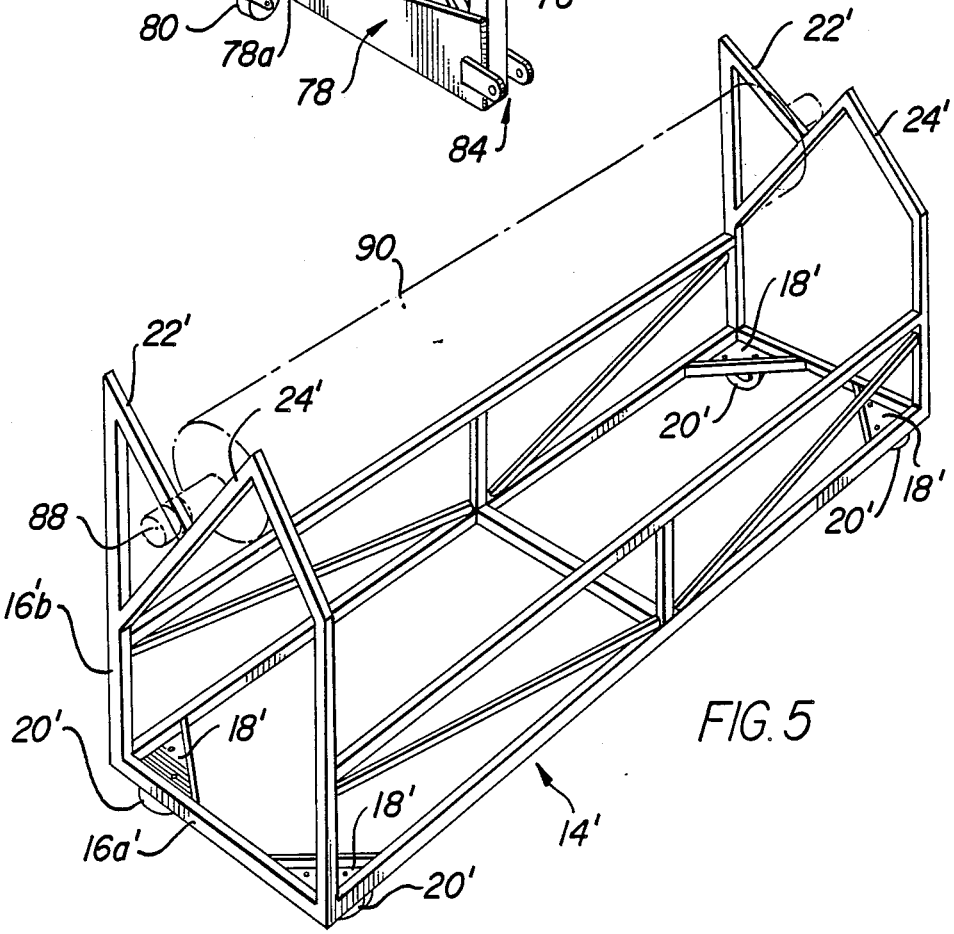
FIG. 5 is a perspective view of an embodiment of the rear section similar to that of FIG. 1.

Referring to FIG. 5, an embodiment of the back rack 14 of FIG. 1 is shown which is very similar to that of FIG. 1 apart from the specific design of the framework. Because of this close similarity, elements in FIG. 5 corresponding to those in FIG. 1 have been given the same reference numerals with primes attached. The only significant difference between the two embodiments concerns the framework, including frame members 22' and 24', which form the "V" or cradle in which the main roll of material 90 is received. FIG. 5 provides a full overall view of these back rack embodiments of the invention and shows more clearly how a roll 90 is supported thereby.

Figure 6:
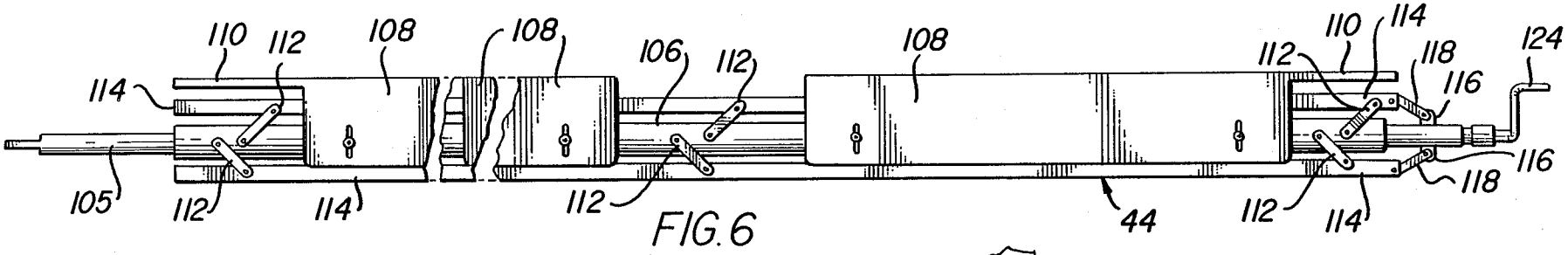
FIG. 6 is a bottom plan view of the expandable take-up shaft device of the machine of FIG. 1.
Figures 7, 10, 11:
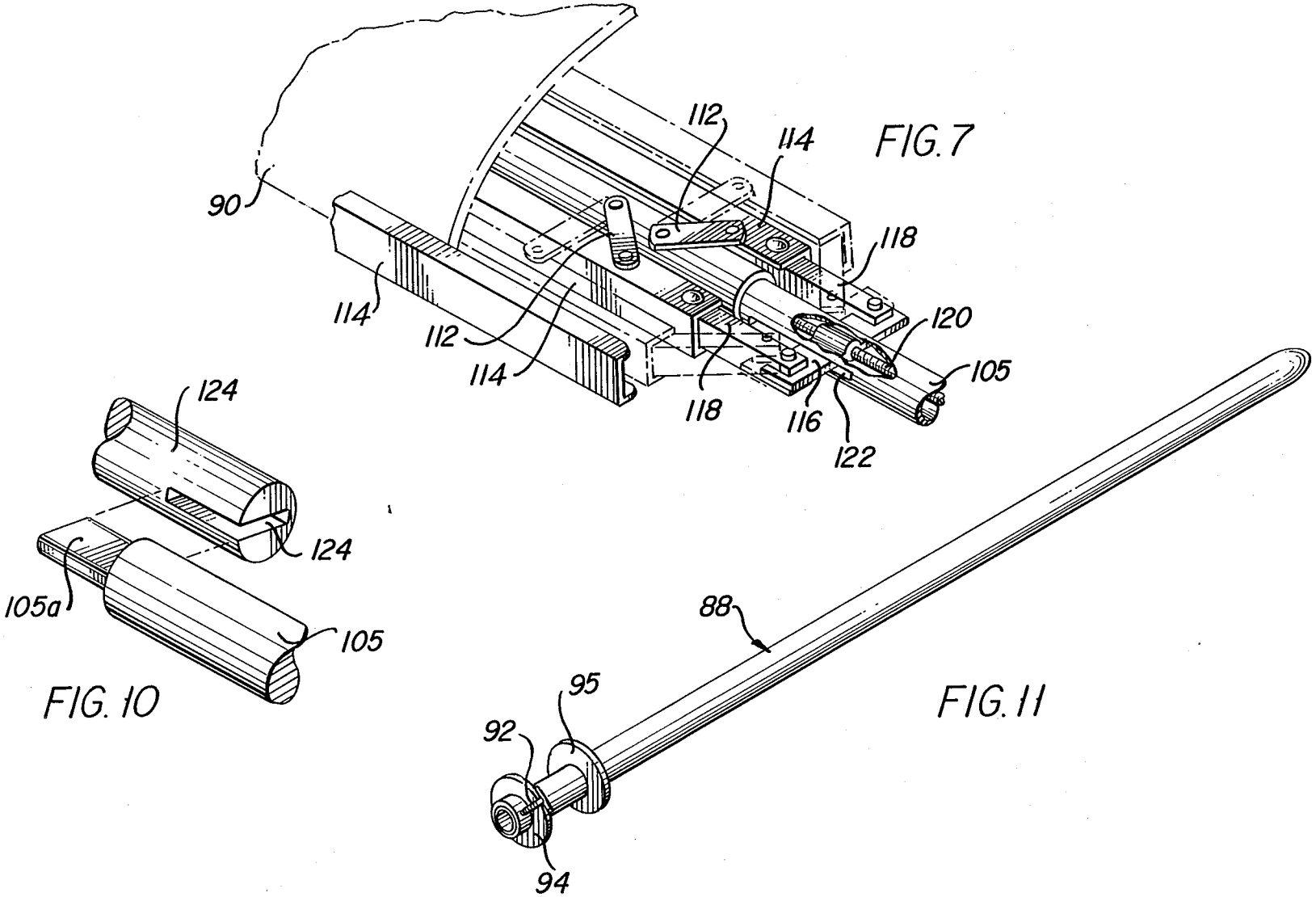
FIG. 7 is a perspective view, partially broken away, of a detail of the expandable take-up shaft device of FIG. 6.
FIG. 10 is an exploded perspective view of the tongue and groove connection of FIG. 8.
FIG. 11 is a perspective view of the back pole of FIG. 5.

Referring to FIGS. 6 and 7, the expandable take-up shaft 44 referred to above includes a central longitudinal shaft or bar 105 supported on opposite ends of frame 28*a* (in the manner described below in connection with FIG. 8 and 9). Shaft 105 includes a central tube or pole 106 in which end portions of shaft 105 are received and to which are secured a plurality of flat plates 108 (see FIG. 6). Plates 108 extend laterally outwardly beyond central tube 106 and carry outer edge holding bars 110. Tube 106 also has pivotably affixed thereto a series of spreader links 112 which are grouped in pairs and which are pivotably connected at the other ends thereof to a pair of channel shaped bars 114. Lateral movement of channel bars 114 towards and away from tube 106 is controlled by a travelling wing nut 116 the lateral ends of which extend laterally outwardly from shaft 105 on opposite sides thereof. The lateral ends of travelling wing nut 116 are connected by links 118 to respective channel bars 114 as shown in FIG. 7. Wing nut 116 travels along an elongate rotatable screw or threaded rod 120 mounted within a hollow end portion of shaft 105, with the lateral sides of wing nut 116 extending outwardly through slots 122 (one of which is indicated in FIG. 7) formed in shaft 105. Rotation of screw member 120 is effected by a handle 124 (FIG. 6) located at on end of shaft 105.

With the arrangement described above, and considering the position of the elements shown in solid lines in FIG. 7, rotation of handle 124 in a first direction causes movement of wing nut 116 therealong so that connector links 118 force channel bars 114 outwardly, away from central tube 106, to the positions shown in dashed lines. Thus, the outer channel bar 114 is brought into close proximity to edge bar 110 so as to permit the edge of the floor covering material 90 to be captured therebetween as is also indicated in dashed lines. Movement of wing nut 116 in the opposite direction causes contraction of channel bars 114 to provide release of the floorcovering edge, as well as to enable the take-up shaft 44 to be withdrawn from a roll of floorcovering material wound thereon at the end of the entire process.

Figure 9:
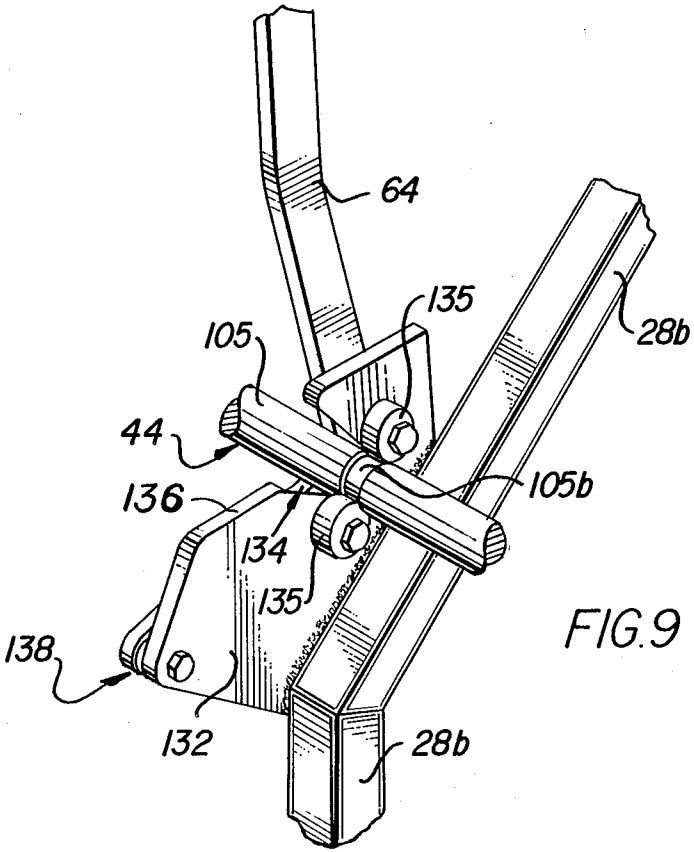
FIG. 9 is a perspective view of a detail of the other end of the take-up shaft release mechanism of FIGS. 1 and 7.
Figure 8:
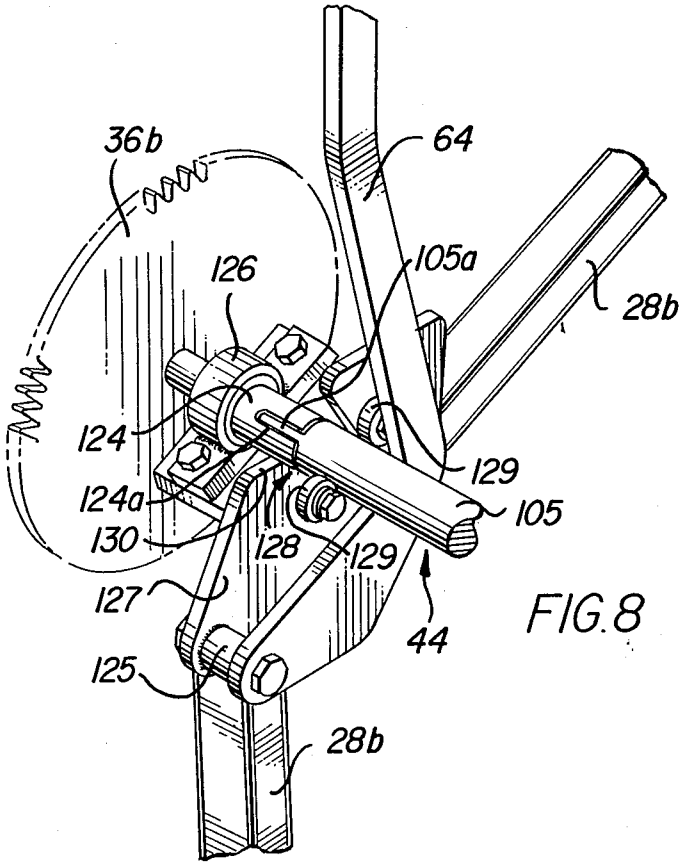
FIG. 8 is a perspective view of a detail of one end of a first embodiment of the take-up shaft release mechanism of FIG. 1.

Referring to FIG. 8 and 9, the release mechanism for take-up shaft device 44 is shown. As shown in FIG. 8, a stub shaft 124, connected to sprocket 36*b* and supported on support frame 28*b* by a pillar bearing device 126, includes a groove 124*a* formed therein in which is engaged a tongue 105*a* formed on central shaft 105 of take-up shaft device 44. One control handle 64 is pivotably mounted by a pivot assembly 125 on a mounting plate or bracket 127 secured to frame 28*b*. Mounting plate 127 includes a slot 128 through which shaft 105 extends, and a flat surface 130 on which shaft 105 can rest after being disengaged from stub shaft 124 through the action of control arm 64. Mounting plate 127 also carries three roller bearings 129 (two which are shown) on which shaft 105 is supported. The tongue and groove arrangement is shown in more detail in FIG. 10 which shows main shaft 105 after being disengaged from stub shaft 124.

Referring to FIG. 9, the support arrangement for the other end portion of shaft 105 includes a mounting plate or bracket 132 which is secured to frame portion 28*b* and, which is similar to that at the other end. Mounting plate 132 includes a slot 134 therein around which are arranged three roller bearings 135 (two of which are shown) that support a grooved portion 105*b* of shaft 105, as well as a rest surface 136. The second manually operated handle 64 is pivotably mounted to mounting plate 132 by a pivot assembly 138 and is adapted to lift shaft 105 out of the normal resting place thereof in slot 134 in mounting plate 132.

Figure 12:
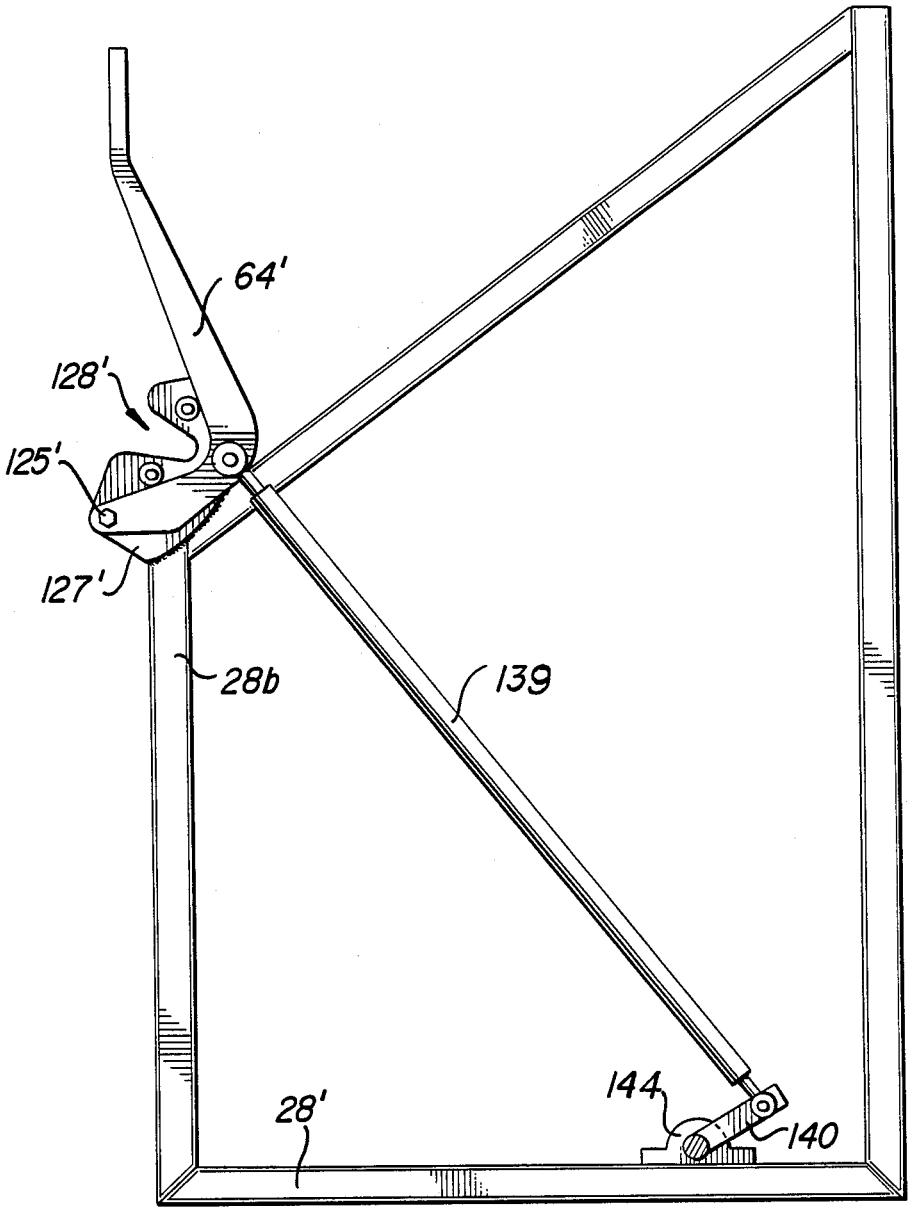
FIG. 12 is a simplified side elevational view of a further embodiment of the take-up shaft release mechanism.
Figure 13:
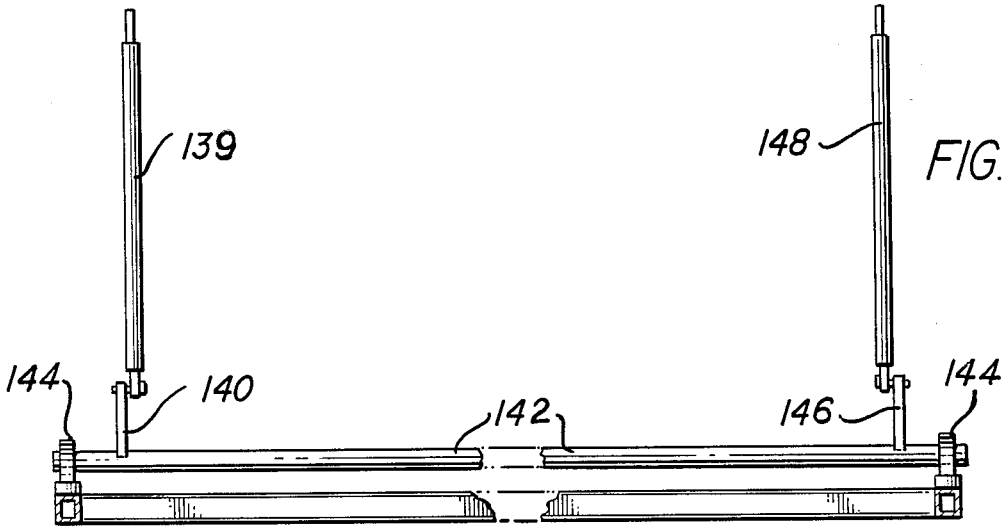
FIG. 13 is a simplified front elevational view of the mechanism of FIG. 12.

Referring to FIGS. 12 and 13, an alternate, presently preferred embodiment of the take-up shaft release mechanism is shown. Some of the basic components of the mechanism described above in connection with FIGS. 8 and 9 are employed in the embodiment of FIGS. 12 and 13 and similar components have been given the same reference numerals with primes attached. The chief difference between the embodiment of FIGS. 12 and 13 and that described previously is that a single operating handle 64' is used, although the pivoted base portion of the other handle is retained, and the base portions of the two "handles" 64' are interconnected so that operation of the one handle 64' operates both and thereby lifts both ends of shaft 105 out of the rest positions thereof. This interconnection is effected by a linkage mechanism which includes a long link 139 pivotably connected to the control arm 64' and to a short link 140 which is, in turn, affixed to a rotatable shaft 142 mounted by pillar bearings 144 on base frame 28*a'*. As indicated in FIG. 13, at the other end of shaft 142, a similar short link 146, affixed to shaft 142, is pivotably connected to a similar long link 148 which is, in turn, adapted to be pivotably connected to the base portion of the other "handle" (not shown) in a similar manner to handle 64'. Thus, operation of the first handle 64' to cause pivoting thereof also causes pivoting of the base portion of the second, remote "handle" at the same time, and thus provides simultaneous lifting of the ends of the take-up shaft device 44 from their respective rest positions.

Considering the operation of the apparatus of the invention using the "back rack" unit 14 (or 14'), a roll of floorcovering 90 is brought by a fork lift (not shown) to the back of the apparatus and the back pole 88 is slid over the lift pole of the fork lift. The locking bolt 94 of the back pole 88 is then tightened against the lift pole to allow working space adjacent to the fork lift. The floorcovering to be cut and rolled is then picked up with the fork lift and the pole is lowered into the "V" groove or cradle formed by members 22 and 24 (or 22' and 24') at each end of the "back rack" unit. The back pole 88 is positioned by the fork lift at the bottom of this "V" groove and it will be appreciated that the V-shape of the cradle permits the fork lift operator to easily align the fork lift with the cutting and rolling machine. In this regard, if the pole 88 hits any part of the inside of the "V", the apparatus will automatically align itself to the fork lift because of the rolling casters 20 provided on back rack 14 which permit the back rack to move toward the fork lift as downward pressure is provided within the "V" from the fork lift. Thus, as the pole 88 slides further into the "V", the back rack continues to align itself until the pole 88 is positioned at the bottom of the "V".

The main unit 12 and the back rack unit 14 are made separately, inter alia, so as to permit the main unit 12 to freely travel to the left or right while floorcovering is being wound so as to compensate for any conning problems. The two units 12 and 14 are connected to each other by latches 66 as described above, with the construction of these latches permitting the two units to be connected and held together by simply pushing one unit against the other. Latches 66 also permit lateral movement of the main unit 12.

Considering the loading operation of the base or main (supply) roll using the hydraulic lifting unit shown in FIG. 4, two units corresponding to that illustrated in FIG. 4 are bolted to the back of the main frame 28*a* of the main unit 12 at each end thereof as described above. Each hydraulic lifting unit 74 includes a lifting arm 86 which moves up and down under the control of a hydraulic jack 98 as also was described previously. When hydraulic lifting units 74 are employed, the back pole 88 slid into the pole core and the jacks 98 are used to lift the back pole 88 to the desired level. As explained above, when this level is reached, the central post or brace 100 is pinned with pin 103 so that the bottom of the lifting arm 86 rests on the pin.

Considering the operation of the apparatus once the roll of floor covering is positioned on the back of the apparatus, (regardless of which embodiment is employed), the edge of the roll 90 is pulled onto the main unit 12 to a location even with the slot 56 in the cutting bar 54. The counter associated with measuring device 62 is then set to zero and the apparatus is ready to measure off a length of material.

In the next step, the front edge of the floor covering material is pulled down and slid into the slot between the edge holding bar 110 and the adjacent expandable or movable bar 114. As described above, expansion and contraction of bars 114 is controlled by a handle 124 connected to a threaded rod or screw member 120 located at one end of the take-up shaft device 44. Travel of the wing nut 116 along the threaded rod 120 cause movement of the channel bar away from the central tube or pipe 106. In particular, in the embodiment under consideration, the travelling wing nut 116 moves to the left to cause the clamping channel bars 114 to be forced away from the central pipe or tube 106 and moves to the right to cause the channel bars 114 to contract and return to the original positions thereof. With the edge of the floorcovering 90 captured between edge holding or channel bar 114 and clamping bar 110, the material is now ready to be rolled and measured.

The two wheels 62*a* on the measuring device 62 rotate as the floorcovering 90 passes therebeneath and the counter associated with the measuring device 62 counts the number of rotations. Thus, the floorcovering 90 is measured during winding thereof onto take-up shaft device 44 by motor 34 through the chain-and-sprocket drive 36. It will be understood that the illustrated, motorized unit described above can be replaced by a hand crank. As described hereinbefore, shaft 105 rides on two sets of three roller bearings 129 and 135 located at opposite ends of the apparatus which hold the bar in place during the roll-up and measuring stage and which thereafter allow the bar to be easily removed.

The control unit 38 of the motor control system is operated by turning the speed control knob (not shown) to zero and then toggling the power switch (not shown) to the forward position so that by turning the speed control knob up, the speed of the roll can be adjusted to a comfortable working speed. As the desired length of material is approached, the speed of the motor 34 is slowed down and stopped as appropriate. If the motor is operated too long so that too much material is rolled up, the control switch is set to reverse and the roll is unwound.

To provide cutting of the material when the counter of the measuring device 62 indicates that the proper length has been metered out, each end of the cutting bar 54 is clamped with holding clamps (which are not shown but which would be located at the ends of the cutting bar 54) and the floorcovering is cut along the slit 56 using a conventional knive or cutter device.

As discussed above, the cutting bar 54 is attached to the free end of a floatation-type working table or floating table assembly 50. Roller bearings 58 located on the front edge of cutting bar 54 enable the floorcovering to move easily, with little resistance, down over the cutting bar 54. Roller bearings 58 also serve a second purpose, i.e., they enable the roll to run in reverse by keeping the cutting bar 54 from digging into the roll surface. As the floorcovering is rolled around the take-up shaft device 44, the roll increases in size and the working table 50 slides up with the roll. Thus, the larger the diameter of the roll 90, the greater the height of the working table 50. The roller bearings 58 located on the front of the cutting bar 54 also assist the table 50 and providing a smooth ride between the roll 90 and the layer of floor covering on the table 50. One of the principal functions of the floatation working table 50 is to maintain pressure on the roll 90 by resting on the roll being wound, thereby keeping the roll tight during the winding operation.

After the cut has been made, the holding clamps referred to above are released and the roll 90 is bound and is ready to unload off of the apparatus. As noted above, the take-up shaft device 44 is connected to the drive mechanism by the tongue and groove connection best seen in FIG. 10 and before the roll 90 can be released from the machine, the shaft 105 is rotated around until the side of the tongue 105*a* points toward the front of the apparatus. When the control handle 64 is pulled forward, the base thereof picks up the shaft 105 resting thereon so as to permit the shaft 105 to clear the winding apparatus. Thereafter, the handle 64 is pulled further and the roll 90 automatically falls onto the floor or onto a floor dolly. As discussed above, the expandable take-up device 44 can then be contracted and removed from the roll.

Although the present invention has been described relative to preferred embodiments thereof, it will be understood by those skilled in the art that variations and modifications can be effected in these preferred embodiments without departing from the scope and spirit of the invention.

We claim:

1. A measuring, cutting and rolling apparatus for rolls of material, said apparatus comprising:

a movable support frame;

support means mounted on said support frame for receiving and supporting a base roll of material so that material can be unwound therefrom;

an expandable material take-up shaft device mounted on said support frame onto which material from base roll is wound;

drive means for rotating said take-up shaft device so as to provide winding of material from the base roll onto said take-up shaft device;

releasable mounting means for releasably mounting said take-up shaft device on said frame so as to permit the take-up shaft device with a roll of material wound thereon to be removed from the apparatus;

measuring means, mounted on said frame, for measuring the length of the material wound onto said take-up shaft device; and cutting means, mounted on said frame, for assisting in cutting off the material from the base roll when material wound onto the take-up shaft device is of the desired length;

said take-up shaft device including a main shaft and said releasable mounting means including a stub shaft disposed at one end of said main shaft for supporting said main shaft by means of a tongue and groove connection, said apparatus further comprising control means for moving said main shaft laterally of the axis thereof relative to said stub shaft to provide disengagement of said main shaft from said stub shaft at said tongue and groove connection.

2. An apparatus as claimed in claim 1 wherein said support frame comprises first and second separable units and latching means for releasably connecting said units together.

3. An apparatus as claimed in claim 2 wherein said support means is mounted on said first unit and said take-up shaft device, said releasable mounting means, said measuring means and said cutting means are mounted on said second unit.

4. An apparatus as claimed in claim 3 wherein said first and second units include wheels for enabling the units to be moved together and independently.

5. An apparatus as claimed in claim 1 wherein said support means comprises means defining a V-shaped cradle at each end of the support frame into which the base roll of material is lowered.

6. An apparatus as claimed in claim 5 wherein said mans defining said V-shaped cradle comprises opposed sides of the support frame.

7. An apparatus as claimed in claim 6 wherein said support frame comprises first and second separable units and latching means for releasably connecting said sections together, and wherein said opposed sides of the support frame comprise sides of said first unit.

8. An apparatus as claimed in claim 5 wherein said support means comprises support arms for receiving the base roll of material and hydraulic means for lifting and lowering said support arms so as to enable receipt of the base roll of material therein.

9. An apparatus as claimed in claim 1 wherein said drive means for said take-up shaft device includes a motor driven sprocket and drive chain unit.

10. Apparatus as claimed in claim 1 wherein the end of the main shaft opposite to said tongue and groove connection is received in a slot provided in said frame and wherein said control means lifts said main shaft to a rest position on said frame after disengagement of said main shaft from said stub shaft.

11. A measuring, cutting and rolling apparatus for rolls of material, said apparatus comprising:

a movable support frame;

a support means mounted on said support frame for receiving and supporting a base roll of material so that material can be unwound therefrom;

an expandable material take-up shaft device mounted on said support frame onto which material from base roll is wound;

drive means for rotating said take-up shaft device so as to provided winding of material from the base roll onto said take-up shaft device;

releasable mounting means for releasably mounting said take-up shaft device on said frame so as to permit the take-up shaft device with a roll of material wound thereon to be removed from the apparatus;

measuring means, mounted on said frame, for measuring the length of the material wound onto said take-up shaft device; and cutting means, mounted on said frame, for assisting in cutting off the material from the base roll when material wound onto the take-up shaft device is of the desired length;

said take-up shaft device comprising clamping means for releasably clamping material from the base roll to the take-up shaft device; and said clamping means comprising a fixed edge holding bar, a first bar, and movement control means for causing movement of said first movable bar between a first, open position spaced from said edge holding bar so as to define a gap therebetween through when the free end of the material from the base roll can be inserted and a second, clamping position wherein the free end of the material is clamped between the edge holding bar and the movable bar;

said movement control means including a rotatable screw member, a travelling nut movable longitudinally along said screw member, at least one pivotable connector member, connected to said travelling nut and to said at least one clamping bar, which pivots responsive to movement of said travelling nut to provide lateral expansion and contraction of said at least one clamping bar, and means for controlling movement of said travelling nut along said screw member; and said take-up shaft device further comprising a central shaft, a further movable bar located on the opposite side of said central shaft from said first movable bar and connected by a further said connector member to said travelling nut, and a plurality of spreader links interconnecting said central shaft and said movable bars.

12. A measuring, cutting and rolling apparatus for rolls of material, said apparatus comprising:

a movable support frame;

support means mounted on said support frame for receiving and supporting a base roll of material so that material can be unwound therefrom;

an expandable material take-up shaft device mounted on said support frame onto which material from base roll is wound;

drive means for rotating said take-up shaft device so as to provide winding of material from the base roll onto said take-up shaft device;

releasable mounting means for releasably mounting said take-up shaft device on said frame so as to permit the take-up shaft device with a roll of material wound thereon to be removed from the apparatus;

measuring means, mounted on said frame, for measuring the length of the material wound onto said take-up shaft device; and cutting means, mounted on said frame, for assisting in cutting off the material from the base roll when material wound onto the take-up shaft device is of the desired length;

said support frame including side portions and an elongate upper frame member which extends between said side portions, and said cutting means comprising a floating cutting table assembly, hinged along one edge to said upper frame member, which bears against the material roll as the material is being wound onto said take-up shaft device.

13. An apparatus as claimed in claim 12 wherein said cutting means further includes a cutter bar located at the edge of said floating table assembly opposite the hinged edge.

14. A measuring, cutting and rolling apparatus for rolls of material, said apparatus comprising:

a movable support frame;

support means mounted on said support frame for receiving and supporting a base roll of material so that material can be unwound therefrom;

an expandable material take-up shaft device mounted on said support frame onto which material from base roll is wound;

drive means for rotating said take-up shaft device so as to provide winding of material from the base roll onto said take-up shaft device;

releasable mounting means for releasably mounting said take-up shaft device on said frame so s to permit the take-up shaft device with a roll of material wound thereon to be removed from the apparatus;

measuring means, mounted on said frame, for measuring the length of the material wound onto said take-up shaft device; and cutting means, mounted on said frame, for assisting in cutting off the material from the base roll when material wound onto the take-up shaft device is of the desired length, said take-up shaft device includes a main shaft and said releasable mounting means includes a stub shaft disposed at one end of said main shaft for supporting said main shaft by means of a tongue and groove connection, said apparatus further including control means for providing disengagement of said main shaft from said stub shaft at said tongue and groove connection, said control means comprising a pair of pivotable control members disposed adjacent to respective ends of said main shaft and pivotable to exert force on said ends of the main shaft to thereby cause disengagement of the take-up shaft device from the stub shaft when said tongue and groove connection is in a predetermined angular orientation.

15. An apparatus as claimed in claim 14 wherein each of said control members include an offset portion at the pivoted end thereof which is disposed under said main shaft and which exerts a lifting force on said main shaft when said control member is pivoted.

16. An apparatus as claimed in claim 14 wherein at least one of said control members comprises a manually operable control handle.

17. An apparatus as claimed in claim 15 wherein a single one of said control members comprises a manually operable control handle, and said apparatus further comprises connecting means for interconnecting said control members so that operation of said control handle provides operation of both of said control members.

* * * * *